US009414693B2

(12) United States Patent
Fifer, III et al.

(10) Patent No.: US 9,414,693 B2
(45) Date of Patent: Aug. 16, 2016

(54) REPLACEABLE BASECOVER MECHANISM

(71) Applicant: L&P PROPERTY MANAGEMENT COMPANY, South Gate, CA (US)

(72) Inventors: Donald Gordon Fifer, III, Carl Junction, MO (US); Teri Meyer, Carthage, MO (US); Josiah David Prieto, Clever, MO (US); Chad Baker, Georgetown, KY (US); Steven W. Kelley, Joplin, MO (US); William Rohr, Joplin, MO (US); Daniel Wade Williams, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 14/810,219

(22) Filed: Jul. 27, 2015

(65) Prior Publication Data

US 2015/0366369 A1 Dec. 24, 2015

Related U.S. Application Data

(63) Continuation-in-part of application No. 14/311,241, filed on Jun. 21, 2014, now Pat. No. 9,089,224.

(51) Int. Cl.

| | |
|---|---|
| ***A47C 31/02*** | (2006.01) |
| ***A47C 20/04*** | (2006.01) |
| ***A47C 21/02*** | (2006.01) |

(52) U.S. Cl.

CPC ..... *A47C 31/023* (2013.01); *A47C 20/04* (2013.01); *A47C 21/026* (2013.01)

(58) Field of Classification Search

CPC .... A47C 19/02; A47C 19/021; A47C 19/045; A47C 31/00; A47C 31/02; A47C 31/023; A47C 21/026; A47C 20/04; A47G 9/0238

USPC ..... 5/400–405, 493, 663, 692, 54, 738, 5/907; 297/218.1–218.5, 228.12, 228, 297/13, 224, 219.1

See application file for complete search history.

(56) References Cited

U.S. PATENT DOCUMENTS

| | | | |
|---|---|---|---|
| 2,799,327 | A | 7/1957 | Rolfe |
| 3,698,764 | A | 10/1972 | Geddings |

(Continued)

OTHER PUBLICATIONS

Notice of Allowance dated Mar. 18, 2015 in U.S. Appl. No. 14/311,241, 9 pages.

(Continued)

*Primary Examiner* — David E Sosnowski
*Assistant Examiner* — Eric Kurilla
(74) *Attorney, Agent, or Firm* — Shook, Hardy & Bacon, L.L.P.

(57) ABSTRACT

A replaceable basecover mechanism for securing a basecover on an automated furniture item is provided. In embodiments, the replaceable basecover mechanism includes a basecover border having a plurality of border panels, a center panel coupled to the plurality of border panels, and at least one stretch panel coupled to at least one of the plurality of border panels. The stretch panels include at least one j-shaped upholstery channel coupled to the stretch panel, and the j-shaped upholstery channels are configured to removably couple the basecover border to a deckboard of an adjustable furniture item. Additionally, the deckboard may include a locking channel configured to couple to the j-shaped upholstery channels.

19 Claims, 13 Drawing Sheets

(56) References Cited

U.S. PATENT DOCUMENTS

| | | | | | |
|---|---|---|---|---|---|
| 3,842,456 | A * | 10/1974 | Bronstien, Jr. | A47C 31/023 | 248/345.1 |
| 3,928,898 | A | 12/1975 | Smoot et al. | | |
| 3,981,534 | A | 9/1976 | Wilton | | |
| 4,352,524 | A * | 10/1982 | Crosby | A47C 31/023 | 24/442 |
| 5,195,222 | A | 3/1993 | Rink | | |
| 5,586,807 | A * | 12/1996 | Taggart | B60N 2/5825 | 24/336 |
| 5,820,213 | A | 10/1998 | Severinski | | |
| 6,742,205 | B2 | 6/2004 | Dewert et al. | | |
| 6,954,957 | B2 | 10/2005 | Metzger et al. | | |
| 7,000,269 | B2 | 2/2006 | Borda | | |
| 8,701,227 | B2 * | 4/2014 | Rohr | A47C 21/026 | 5/411 |
| 9,089,224 | B1 * | 7/2015 | Baker | A47C 31/023 | |
| 2007/0157388 | A1 * | 7/2007 | Mossbeck | A47C 20/041 | 5/618 |
| 2009/0030456 | A1 * | 1/2009 | Kuo | A61G 15/007 | 606/237 |
| 2011/0247138 | A1 | 10/2011 | Clenet et al. | | |
| 2014/0059769 | A1 | 3/2014 | Baker et al. | | |
| 2014/0325761 | A1 | 11/2014 | Rawls-Meehan | | |

OTHER PUBLICATIONS

Non-Final Office Action dated Nov. 24, 2015 in U.S. Appl. No. 14/810,224, 7 pages.

* cited by examiner

REPLACEABLE BASECOVER MECHANISM

CROSS-REFERENCE TO RELATED APPLICATIONS

This application is a continuation-in-part of U.S. Nonprovisional application Ser. No. 14/311,241, filed Jun. 21, 2014, entitled "Replaceable Basecover Mechanism," now U.S. Pat. No. 9,089,224, the entire contents of which is hereby incorporated by reference. This application is also related to U.S. Nonprovisional application Ser. No. 14/810,224, entitled "Replaceable Basecover Mechanism," filed on the same date as this application, which is incorporated by reference in its entirety.

STATEMENT REGARDING FEDERALLY SPONSORED RESEARCH OR DEVELOPMENT

Not applicable.

TECHNICAL FIELD

Embodiments of the present invention relate to a replaceable basecover mechanism for an automated furniture item. More particularly, embodiments of the present invention relate to a replaceable basecover for removably applying an upholstery material to a portion of an automated furniture item, such as a deckboard of an adjustable bed.

BACKGROUND OF THE INVENTION

Various components of upholstered furniture items may be covered in a number of materials, via multiple methods of attachment. In some instances, a basecover may be applied to a deckboard of an upholstered furniture item using staples, thereby making the cover non-removable and/or difficult to remove. Such basecover devices may prove challenging during product customization, either in a retail environment or a home setting, as the basecover is not intended to be removed and/or exchanged to create a different appearance.

BRIEF SUMMARY OF THE INVENTION

Embodiments of the present invention relate to a replaceable basecover mechanism for an automated furniture item. More particularly, embodiments of the present invention relate to a replaceable basecover for removably applying an upholstery material to a portion of an automated furniture item, such as a deckboard of an adjustable bed.

Accordingly, in one embodiment of the invention, a replaceable basecover mechanism for an adjustable furniture item is provided. The replaceable basecover mechanism includes: a basecover border comprising a plurality of border panels; a center panel coupled to the plurality of border panels; and at least one stretch panel coupled to at least one of the plurality of border panels, the at least one stretch panel comprising at least one j-shaped upholstery channel coupled to the at least one stretch panel. In embodiments, the at least one j-shaped upholstery channel is configured to removably couple the basecover border to a deckboard of an adjustable furniture item, said deckboard comprising at least one mating channel configured to removably couple to the at least one j-shaped upholstery channel.

In another illustrative aspect, a replaceable covering device for an adjustable bed includes a replaceable covering. In some embodiments, the replaceable covering includes: 1) a basecover border comprising a plurality of border panels, said basecover border mated to a perimeter of a deckboard of the adjustable bed, wherein the deckboard comprises a plurality of articulating portions; and 2) a center panel coupled to the plurality of border panels. Additionally, the replaceable covering device includes an elastic tightening mechanism comprising a plurality of stretch panels coupled to the plurality of border panels, and a locking mechanism coupled to each of the plurality of stretch panels, said locking mechanism configured to removably secure the replaceable covering device with respect to a bottom surface of the deckboard. In further embodiments, the locking mechanism includes: 1) at least one j-shaped upholstery channel coupled to each of the plurality of stretch panels; and 2) at least one locking channel corresponding to each of the at least one j-shaped upholstery channels, wherein the at least one locking channel is coupled to a bottom surface of each of the plurality of articulating portions of the deckboard in an orientation parallel to each corresponding j-shaped upholstery channel.

According to a third illustrative aspect, a replaceable basecover mechanism includes: a basecover configured to mate with at least a portion of a perimeter of a deckboard of an automated furniture item, said basecover comprising a rigid material; and a plurality of stretch panels coupled to the basecover, each of the plurality of stretch panels comprising an elastic material and a j-shaped upholstery channel coupled to the elastic material, said j-shaped upholstery channel configured to mate with a locking channel coupled to a bottom surface of the deckboard.

In a fourth illustrative embodiment, a replaceable basecover mechanism for covering at least a portion of an adjustable furniture item shroud includes: a covering material comprising a first edge and a second edge; a first coupling mechanism adjacent the first edge; a second coupling mechanism adjacent the second edge; and a stretch panel adjacent at least one of the first coupling mechanism and the second coupling mechanism, wherein the first coupling mechanism is configured to removably couple to the second coupling mechanism such that the covering material wraps at least a portion of the shroud.

In a fifth illustrative aspect, a replaceable covering device for a surround covering includes: a covering material comprising: (1) a first edge having a first coupling mechanism; and (2) a second edge having a second coupling mechanism, wherein the first coupling mechanism is configured to couple to a third coupling mechanism on an interior surface of a shroud, and further wherein the second coupling mechanism is configured to couple to a fourth coupling mechanism on an interior surface of the shroud.

In a sixth illustrative embodiment, a replaceable basecover mechanism for a shroud covering includes: a covering material for covering at least a portion of a shroud, said covering material having a first edge and a second edge; a first coupling mechanism coupled to the first edge; and a second coupling mechanism coupled to the second edge, said second coupling mechanism configured to overlap at least a portion of the first coupling mechanism.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention relate to a replaceable basecover mechanism for an automated furniture item. More particularly, embodiments of the present invention relate to a replaceable basecover for removably applying an upholstery material to a portion of an automated furniture item, such as a deckboard of an adjustable bed.

Figure 1:
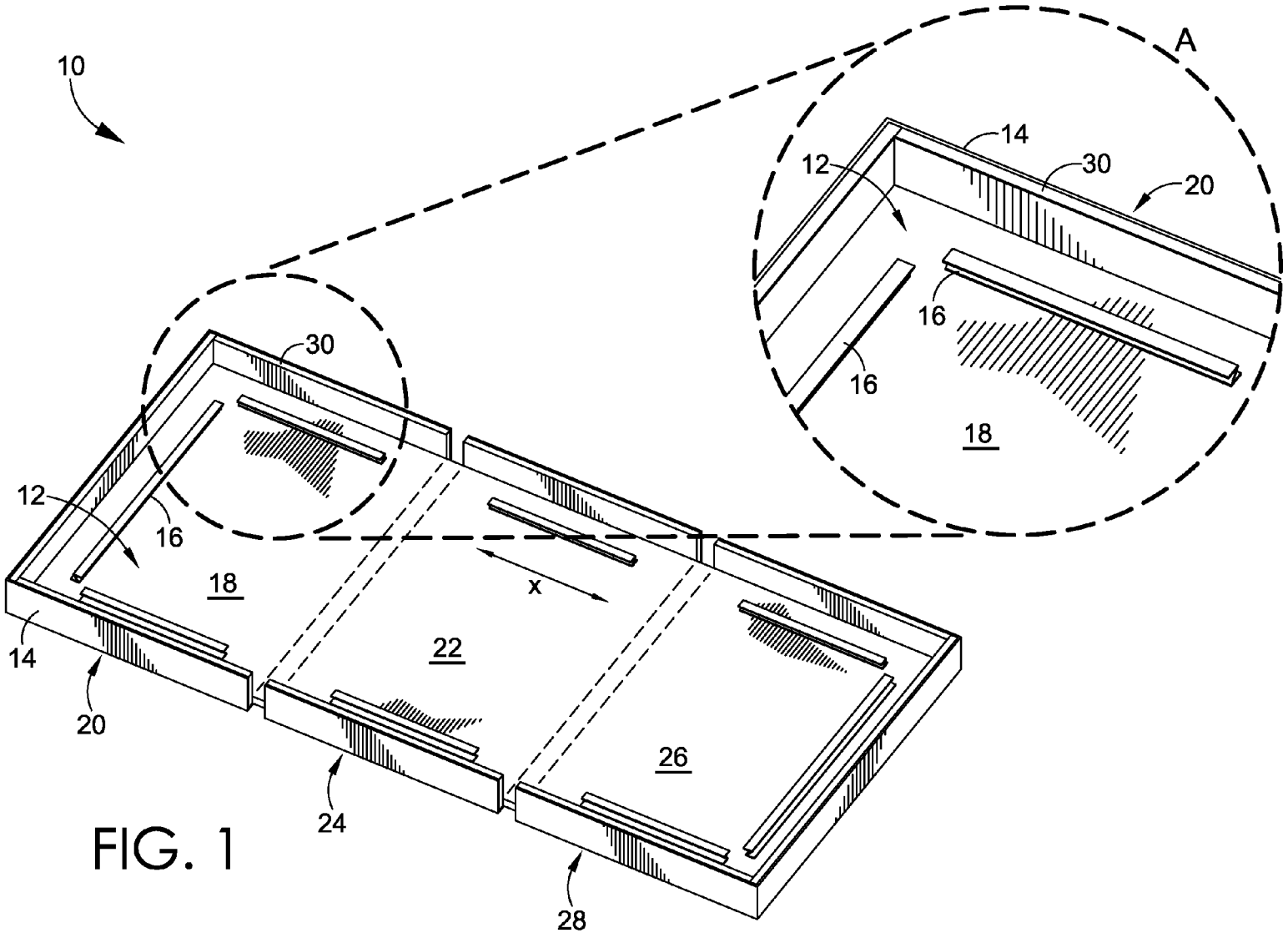
FIG. 1 is a bottom, perspective view of an exemplary adjustable bed deckboard configured to couple to a replaceable basecover mechanism, with an enlarged portion A of the deckboard, in accordance with an embodiment of the invention.

Referring now to FIGS. 1-5, where like numerals depict like elements, various views of embodiments of a replaceable basecover mechanism are provided. In FIG. 1, a bottom, perspective view of a deckboard 10 for use with a replaceable basecover includes a series of adjacent, articulating deckboard panels 12, with multiple side panels 14 extending from the panels 12 to provide a depth to the bottom side of the articulating deckboard panels 12. As further shown in the embodiment of FIG. 1, the bottom side of the deckboard of the automated furniture item includes multiple z-shaped locking channels 16 configured to mate with at least a portion of the replaceable basecover mechanism, as discussed below in further detail.

In one embodiment, each locking channel 16 is coupled to a corresponding bottom surface 18 of one of the plurality of articulating deckboard panels 12, such as the locking channels 16 coupled to the bottom surface 18 of the first base portion 20, the locking channels 16 coupled to the bottom surface 22 of the second base portion 24, and the locking channels 16 coupled to the bottom surface 26 of the third base portion 28. In some embodiments, multiple locking channels 16 are divided among the first, second, and third base portions 20, 24, and 28, such that articulation of the plurality of base portions is not obstructed by a locking channel 16 spanning across multiple base portions. As such, according to one embodiment of the invention, a z-shaped locking channel 16 may be stapled to a bottom surface of a deckboard in segmented portions configured to allow multiple panels and/or portions of the deckboard to articulate without damage to the locking channels 16.

In some embodiments, locking channels 16 may be made from any material configured to retain a shape during tensioning of the locking channel 16 against at least a portion of the replaceable basecover mechanism. In one example, the locking channels 16 are made from a thin-gauge metal and/or plastic material assembled in a particular orientation for locking to the replaceable basecover mechanism. Although depicted in the enlarged view A of FIG. 1 as being z-shaped, one or more of the locking channels 16 may be a different shape, such as an arch-shaped, barrel-shaped, channeled, disc-shaped, spiral-shaped, j-shaped, or other shaped locking channel 16 that is configured to couple to the replaceable basecover mechanism.

During assembly, locking channels 16 may be coupled to a bottom surface of the deckboard using one or more fastening mechanisms, such as staples, bolts, screws, adhesives, and the like. In one embodiment, multiple z-shaped locking channels 16 are coupled to the bottom surfaces of multiple deckboard panels/portions of an automated furniture item. In the example of FIG. 1, multiple z-shaped locking channels 16 are coupled near a perimeter of a bottom surface of the articulating deckboard panels 12. As such, in some embodiments, a positioning of the coupling of each of the locking channels 16 is determined based on a threshold distance from an outer edge of the articulating deckboard panels 12. For example, each of the plurality of z-shaped locking channels 16 may be positioned at a consistent distance from an outer edge of the perimeter of the articulating deckboard panels 12, thereby providing a consistent set-back from the edge of the bottom surfaces 18, 22, and 26.

With continued reference to FIG. 1, the enlarged portion A of the bottom view of deckboard 10 includes a portion of the first base portion 20 having a depth created by the side panels 14, and a bottom edge 30 of each side panel 14. In this view, in one embodiment, each of the z-shaped locking channels 16 coupled to the bottom surface 18 are positioned at a particular distance from the outer perimeter of the first base portion 20, and from the bottom edges 30 of the side panels 14. As such, in some embodiments, a covering material of the replaceable basecover mechanism applied over and/or around the side panels 14 and bottom edges 30 provides a tightening distance across which a portion of the replaceable basecover mechanism will span (e.g., the stretch panel 40 portion discussed below).

Figure 2:
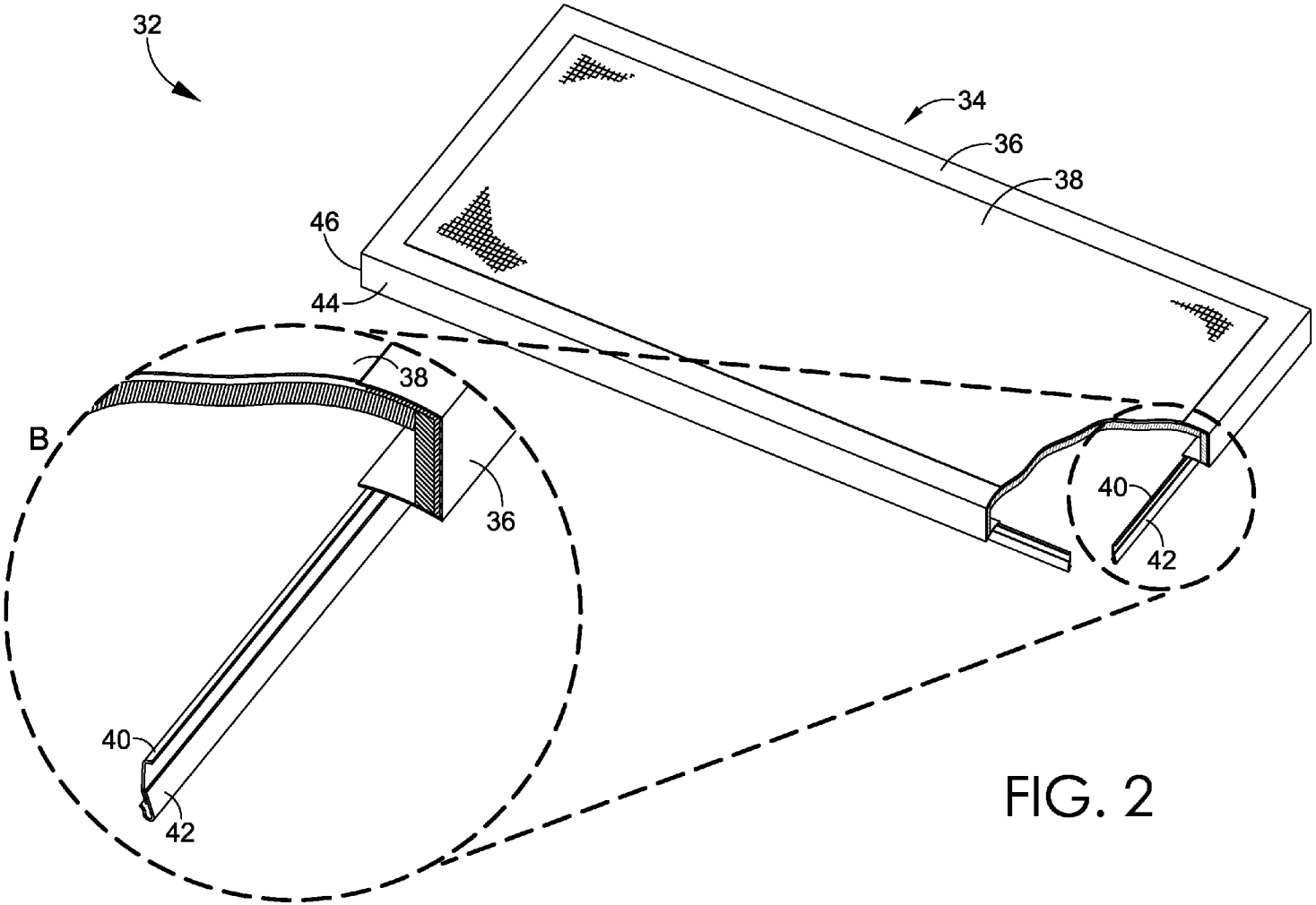
FIG. 2 is a partially cut-away, top perspective view of a replaceable basecover mechanism, with an enlarged portion B of the replaceable basecover mechanism, in accordance with embodiments of the invention.

Referring next to FIG. 2, a partially cut-away, top perspective view of a replaceable basecover mechanism 32, with an enlarged portion B of a portion of the replaceable basecover mechanism 32, is provided in accordance with embodiments of the invention. As shown in FIG. 2, the replaceable basecover mechanism 32 includes a basecover border 34 having multiple border panels 36, a center panel 38, and multiple stretch panels. 40. In one embodiment, the replaceable basecover mechanism 32 may be a single material, having various panels and/or parts as described herein. In further embodiments, the particular portions of the replaceable basecover mechanism 32 may be made from particular materials corresponding to a position and/or function of the portions of the device. For example, in the embodiment of FIG. 2, the border panels 36 of the basecover border 34 may be made from a fitted and/or rigid basecover material that is sewn in a particular configuration to conform to a perimeter of a deckboard, such as the deckboard 10 of FIG. 1. Accordingly, in some embodiments of the invention, the border panels 36 are sewn from a first material that provides a fitted and/or structured body to the basecover border 34.

In further embodiments of the invention, the center panel 38 may be made from a second material that is different than the first material of the border panels 36. In one example, the center panel 38 may be a second material that is configured to contact a particular portion of an automated furniture item, such as a bottom surface of a mattress adjacent the deckboard of an adjustable bed. In another example, the second material of the center panel 38 may provide a particular function for the automated furniture item, such as a textured material configured to restrict travel of a mattress resting on top of the articulating deckboard panels 12 covered by the replaceable basecover mechanism 32.

With continued reference to FIG. 2, the replaceable basecover mechanism 32 also includes multiple stretch panels 40 that provide a tightening function for securing the replaceable basecover mechanism 32 to a deckboard of an automated furniture item, such as an adjustable bed. In embodiments, the stretch panels 40 are made from a third material having particular elastic properties that provide resistance in a direction of pull from an applied replaceable basecover mechanism 32. In one example, the replaceable basecover mechanism 32 may include multiple stretch panels 40 coupled to multiple border panels 36, for securing the border panels 36 around a perimeter of a furniture item. As shown in the enlarged view B of FIG. 2, the stretch panels 40 may be coupled to a bottom surface of the border panels 36, set back at a particular distance from the outer perimeter of the basecover border 34 structure. In other words, while the basecover border 34 provides a rigid "frame" fabric structure, including multiple border panels 36, the border panels 36 may be sewn in such a way as to provide a top surface mated to center panel 38, a bottom surface mated to a stretch panel 40, and a side surface wrapping around a vertical perimeter. As further shown in enlarged portion B, in some embodiments of the invention, the border panels 36 form a c-shaped member around a perimeter of the deckboard, while the stretch panels 40 are coupled to the border panels 36 at a threshold distance from the outer perimeter of the vertical edge of the basecover border 34.

Figure 3:
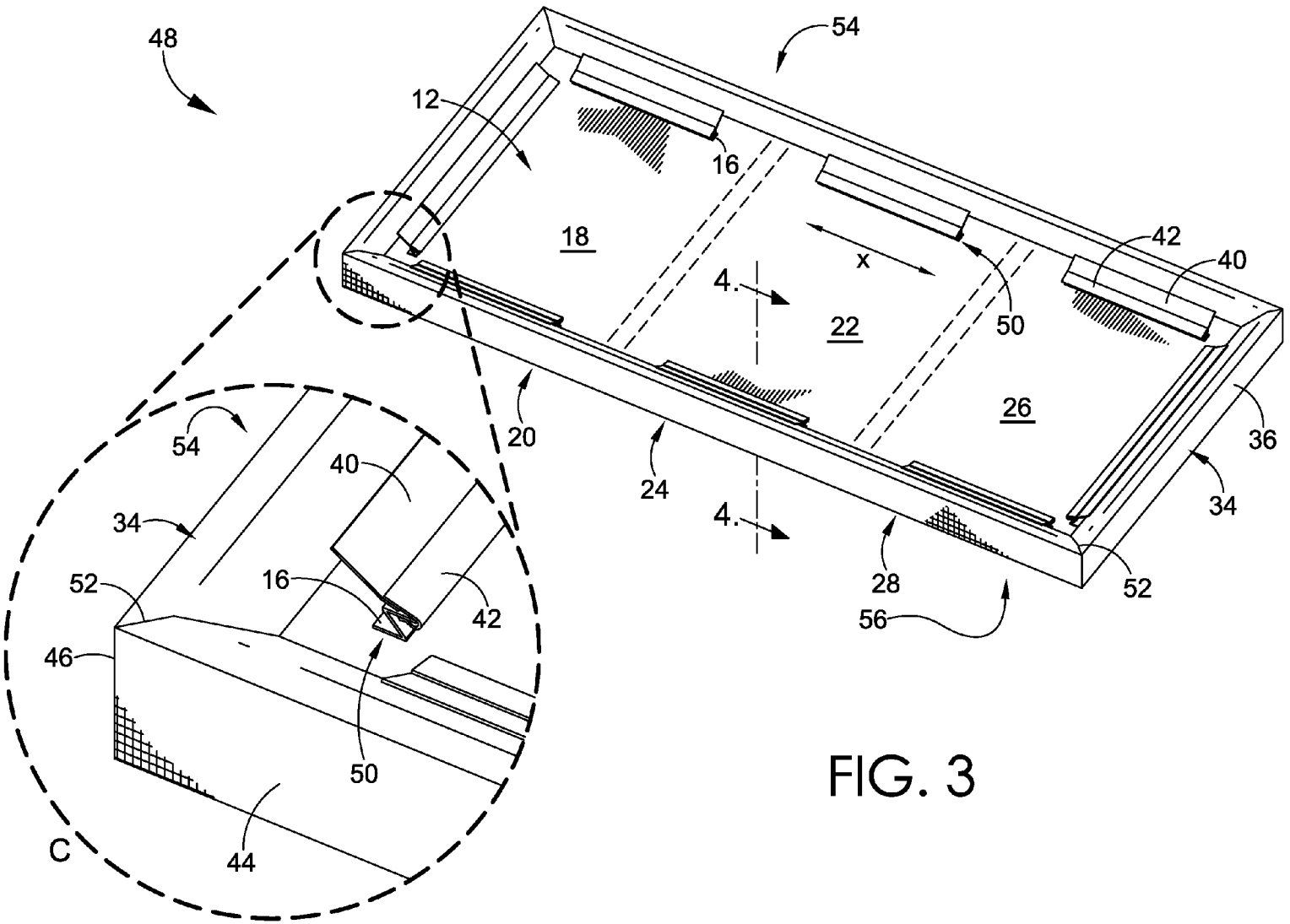
FIG. 3 is a bottom, perspective view of a replaceable basecover mechanism, with an enlarged portion C of the replaceable basecover mechanism, in accordance with an embodiment of the invention.

Also shown in the enlarged detail of portion B, a j-shaped upholstery channel 42 is coupled to the stretch panels 40 of the replaceable basecover mechanism 32, according to embodiments of the invention. In the example of FIG. 2, the j-shaped channels 42 are coupled to a bottom edge of the stretch panels 40, while an opposing/top edge of the stretch panel 40 is coupled to the border panel 36. The replaceable basecover mechanism 32 of the example of FIG. 2 includes border panel sides 44 (i.e., the vertical sides of the c-shaped member of the basecover border 34). Each of the adjoining border panel sides 44 meet at a border panel corner 46, providing a tightly wrapped appearance for the replaceable basecover mechanism 32. In another embodiment, the replaceable basecover mechanism 32 is configured to cover a variety of different shapes and/or profiles of various upholstered members of an automated furniture item. In other words, while the example of FIG. 2 discusses covering of a c-shaped member of the basecover border 34, in further embodiments of the invention, the basecover border 34 may have a differently shaped profile. In one embodiment, the replaceable basecover mechanism 32 may be configured to conform against a curved, angled, and/or textured profile, or any variety of different profiles of a deckboard covered by the replaceable basecover mechanism 32. In another example, Turning next to FIG. 3, a bottom, perspective view of a replaceable basecover mechanism 48, with an enlarged portion C of the replaceable basecover mechanism 48, is provided in accordance with an embodiment of the invention. In the example of FIG. 3, a replaceable basecover mechanism 48 is coupled to an exemplary deckboard of an automated furniture item, such as the deckboard 10 of FIG. 1. In coupling the replaceable basecover mechanism 48 to the articulating deckboard panels 12, multiple coupled locking mechanisms 50 are formed between the locking channels 16 and the j-shaped upholstery channels 42. In one embodiment of the invention, the j-shaped upholstery channels 42 are oriented along a longitudinal axis x, for coupling directly to the corresponding locking channels 16 oriented along the same axis x.

In embodiments of the invention, the basecover border 34, having border panel sides 44 and border panel corners 46, forms a series of mitered corners 52 around a perimeter of the deckboard. As such, the mitered corners 52 provide a fitted and/or secured covering for the replaceable basecover mechanism. In one embodiment of the invention, an amount of stretch material is sewn into the underside corners of the basecover border 34 to remove slack in the corners of the replaceable basecover mechanism 48 during installation.

As viewed from the bottom side 54 of the replaceable basecover mechanism 48 in FIG. 3, various features of the replaceable basecover mechanism 48 are removably secured with respect to the articulating deckboard panels 12, based on coupled locking mechanism 50. Similarly, by virtue of the coupled locking mechanism 50, the top side 56 of the replaceable basecover mechanism 48 includes center panel 38 adjacent the opposing top surfaces of the articulating deckboard panels 12, according to embodiments of the invention.

Figure 4:
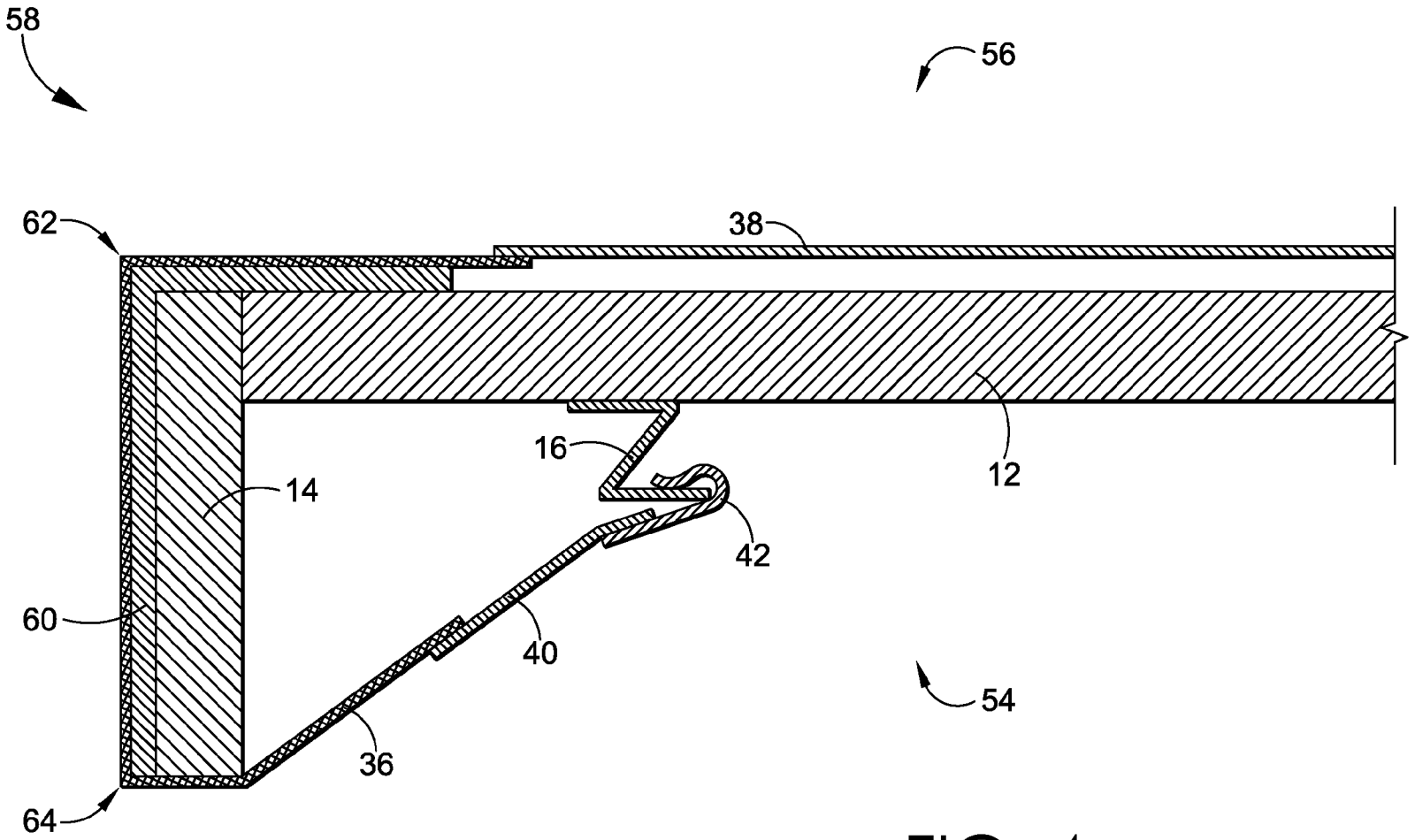
FIG. 4 is a side, cross-sectional view of an exemplary replaceable basecover mechanism applied to a deckboard of an automated furniture item, in accordance with an embodiment of the invention.

With reference to FIG. 4, an exemplary side, cross-sectional view of a replaceable basecover mechanism 58 applied to a deckboard of an automated furniture item is provided in accordance with an embodiment of the invention. With the top side 56 now in an upward orientation, the details of various features of the replaceable basecover mechanism 58 may be seen coupled to the bottom side 54 of the articulating deckboard panels 12. In one embodiment of the invention, the replaceable basecover mechanism 58 may include multiple materials corresponding to different portions and/or functions of the replaceable basecover mechanism 58, such as the first material of the border panel 36, the second material of the center panel 38, and the third material of the stretch panel 40. As will be understood, while the border panel 36, center panel 38, and stretch panel 40 are depicted in an overlapping orientation in FIG. 4, the adjacent materials may be coupled in any number of seamed and/or sewn fashions, and embodiments of the invention are not limited to one particular joining mechanism.

In embodiments of the invention, center panel 38 may be sewn to border panel 36 at a first edge of border panel 36, while stretch panel 40 may be sewn to a second edge of border panel 36, such that the replaceable basecover mechanism 58 "wraps around" the articulating deckboard panels 12, and the side panels 14. As such, in some embodiments, a replaceable basecover mechanism 58 may be wrapped around a deckboard having a foam edge 60 (e.g., a PE foam edge) mated to at least a portion of the articulating deckboard panels 12 and/or side panels 14. In one embodiment, a border panel top edge 62 is formed based on wrapping the replaceable basecover mechanism 58 around a top side 56, while a border panel bottom edge 64 is formed upon wrapping around the bottom side 54. In further embodiments, the replaceable basecover mechanism 58 may be tightened around a deckboard upon stretching the j-shaped upholstery channel 42 to meet a locking surface of the z-shaped locking channel 16. Accordingly, the stretch panel 40 may serve, in some embodiments, to bias the j-shaped upholstery channel 42 away from the position of the z-shaped locking channel 16.

Based on elongating the stretch panel 40, and applying a tensioned contact with the j-shaped upholstery channel 42, the replaceable basecover mechanism 58 may be removably applied to one of multiple deckboards having particular dimensions. Further, in some embodiments of the invention, a user may replace an existing basecover on a deckboard of an automated furniture item by disconnecting the j-shaped upholstery channels 42 from the corresponding locking channels 16, around a perimeter of the bottom side 54 of the articulating deckboard panels 12. Subsequently, the deckboard may have a different, replaceable basecover mechanism 58 applied to the exterior, thereby providing a different appearance for the deckboard. In one example, a soiled basecover may be replaced by a different basecover, based on detaching the soiled basecover from the bottom surface 54 and applying a different basecover in its place.

Figure 5:
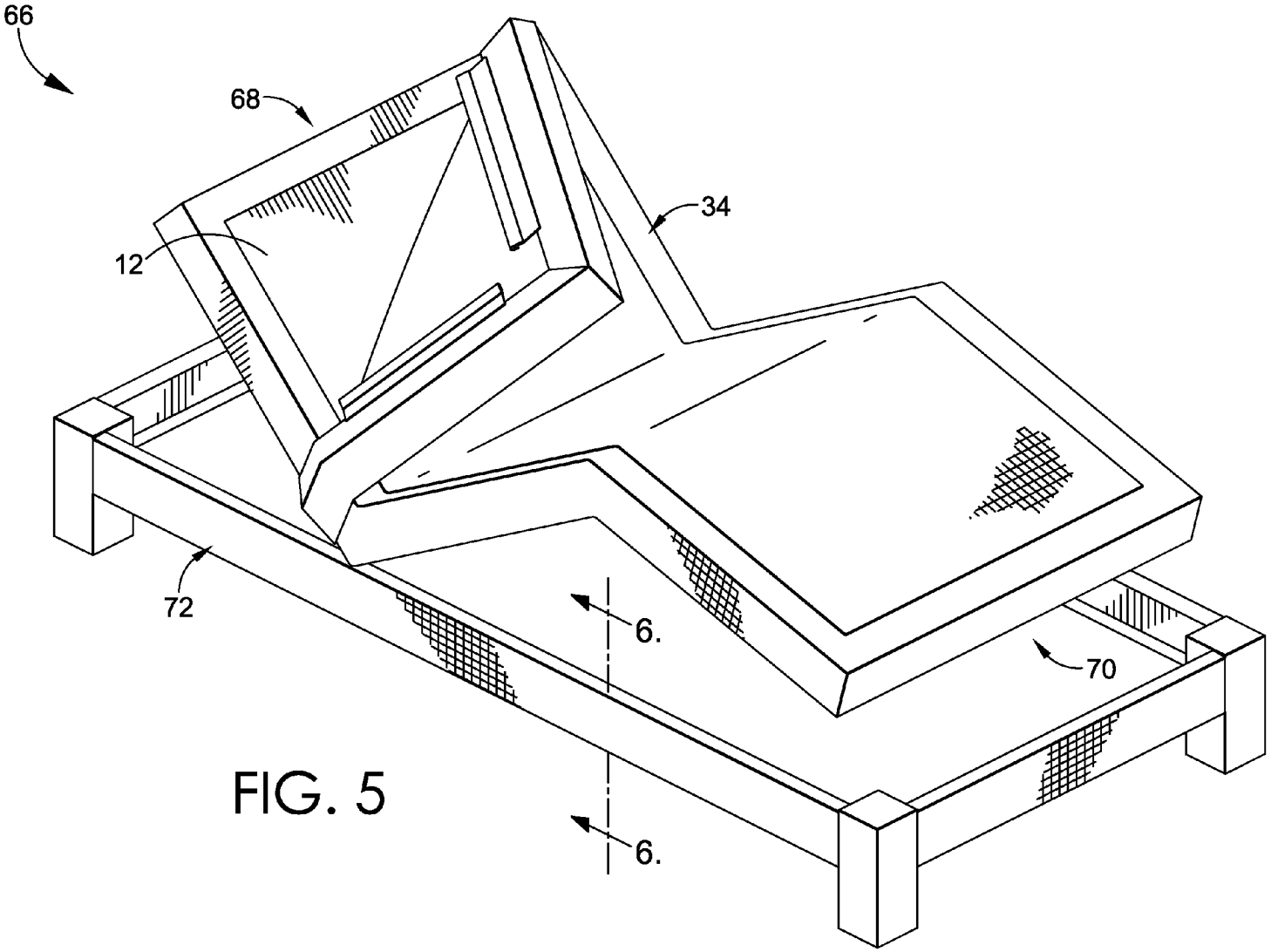
FIG. 5 is a perspective view of an articulated deckboard of an automated furniture item, with an exemplary replaceable basecover mechanism applied to a portion of the deckboard and a portion of the shroud, in accordance with an embodiment of the invention.

With reference to FIG. 5, a perspective view of an articulated deckboard 66 of an automated furniture item (i.e., an adjustable bed) is provided, having an exemplary replaceable basecover mechanism applied to a portion of the deckboard. In this embodiment, the head 68 of the articulating deckboard panels 12 has not been covered by a portion of the basecover border 34 during installation of the replaceable basecover mechanism. In one embodiment of the invention, because of the fitted nature of the basecover border 34, a replaceable basecover border mechanism may be applied to an articulated, automated furniture item based on translating a portion of the automated furniture item away from a neutral position.

In the example of FIG. 5, a replaceable basecover mechanism may first be applied to a foot of an adjustable bed, such as by draping the basecover border 34 around a bottom edge of the deckboard. The replaceable basecover mechanism may then be coupled to the foot of the adjustable bed based on securing one or more of the j-shaped upholstery channels 42 to one or more of the corresponding z-shaped locking channels 16. Upon attaching the foot of the deckboard to the replaceable basecover mechanism, the head of the articulating bed may then be raised, as shown in FIG. 5, to provide for easier attachment of the head of the deckboard to the replaceable basecover mechanism. In this example, an amount of slack in the tension of the replaceable basecover mechanism is created when applying the covering to an articulated deckboard, as compared to a non-articulated deckboard. Upon applying the head of the deckboard to the replaceable basecover mechanism (i.e., mating corresponding j-shaped upholstery channels to z-shaped locking channels), the replaceable basecover mechanism is removably secured with respect to the articulating panels of the deckboard.

In further embodiments of the invention, a replaceable basecover mechanism may also be applied to one or more portions of the shroud 72 associated with at least a portion of the adjustable bed of FIG. 5. In some embodiments of the invention, a corresponding and/or coordinating replaceable basecover mechanism may be provided for covering a deckboard and a shroud of a single automated bed. As such, in some embodiments of the invention, a unified, removable exterior may be applied to one or more features of an adjustable furniture item. In the example of FIG. 5, side portions of the shroud 72 are configured to be covered and/or re-covered with a replaceable basecover mechanism.

Figure 6:
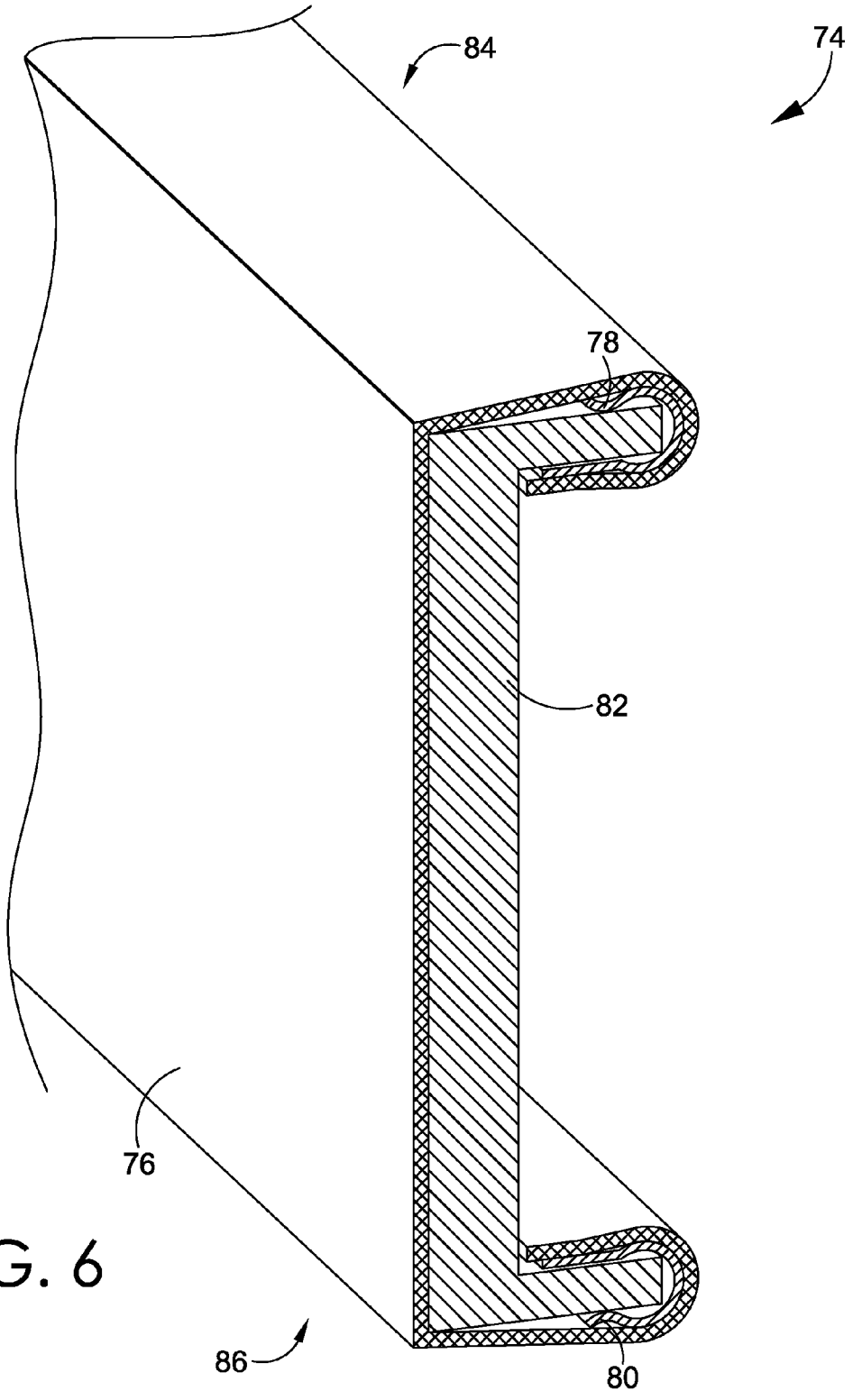
FIG. 6 is a cross-sectional view of a replaceable basecover mechanism configured to cover at least a portion of a shroud, in accordance with an embodiment of the invention.

Referring finally to FIG. 6, in a further embodiment of the invention, a cross-sectional view of a shroud 82 provides one example of a replaceable basecover mechanism 74 configured to cover at least a portion of a shroud 82 surrounding an automated bed. In the embodiment of FIG. 6, the shroud 82 is depicted as having a c-channel form. In further embodiments of the invention, the shroud 82 may be any configuration and/or form for providing a shroud covering to at least a portion of an automated furniture item. In some embodiments of the invention, one or more portions of the shroud 82 may be a c-channel form (and/or other form of shroud profile/configuration), provided based on being extruded, vacuum formed, injection molded and/or hollow. As such, exemplary embodiments of a shroud 82 provide a lightweight surround for an automated furniture item, and may be made from one or more of the following materials: high-density polyethylene (HDPE), polyvinyl chloride (PVC), acrylonitrile butadiene styrene (ABS), and/or polyethylene terephthalate glycol-modified (PETG).

With continued reference to FIG. 6, the replaceable basecover mechanism 74 for the shroud 82 includes a covering material 76, a first j-shaped upholstery channel 78, and a second j-shaped channel 80. In embodiments, the replaceable basecover mechanism 74 is configured to wrap around an upper edge 84 and a lower edge 86 of the portion of the shroud 82 covered by the covering material 76. As such, upon securing the first and second j-shaped upholstery channels 78 and 80 to upper and lower portions of the shroud 82, a removable and/or replaceable covering is provided to the shroud 82. In further embodiments, a replaceable basecover mechanism may include both a deckboard covering, as discussed above with reference to FIGS. 1-5, and a shroud covering, as shown in FIGS. 5-6.

Although a c-channel shroud 82 is depicted in FIG. 6, it will be understood that a replaceable basecover mechanism 74 may be provided to configure to a variety of different profiles of shrouding structures. Further, although j-shaped upholstery channels 78 and 80 are depicted as coupling the covering material 76 to the shroud 82, in some embodiments of the invention, a different configuration of coupling mechanism, such as a differently shaped channel, may be included as part of the replaceable basecover mechanism 74. As shown in the embodiment of FIG. 6, a first j-shaped upholstery channel 78 and a second j-shaped upholstery channel 80 may be positioned along upper and lower edges of the covering material 76 to provide a secured and/or tightened application of the replaceable basecover mechanism 74 to the shroud 82. For example, as configured to mate to a particular shape of shrouding device, embodiments of the replaceable basecover mechanism include upper and lower coupling mechanisms (e.g., first and second j-shaped upholstery channels 78 and 80) that are positioned along edges of the covering material 76 that correspond to a fitted orientation of the covering material 76 with respect to the shroud 82. By such positioning, the replaceable basecover mechanism 74 may be configured to provide an appearance of being a non-removable cover, as the outer and/or visible surface of the covering material 76 applied to the shroud 82 is tightened over upper and lower edges 84 and 86.

Figure 7A:
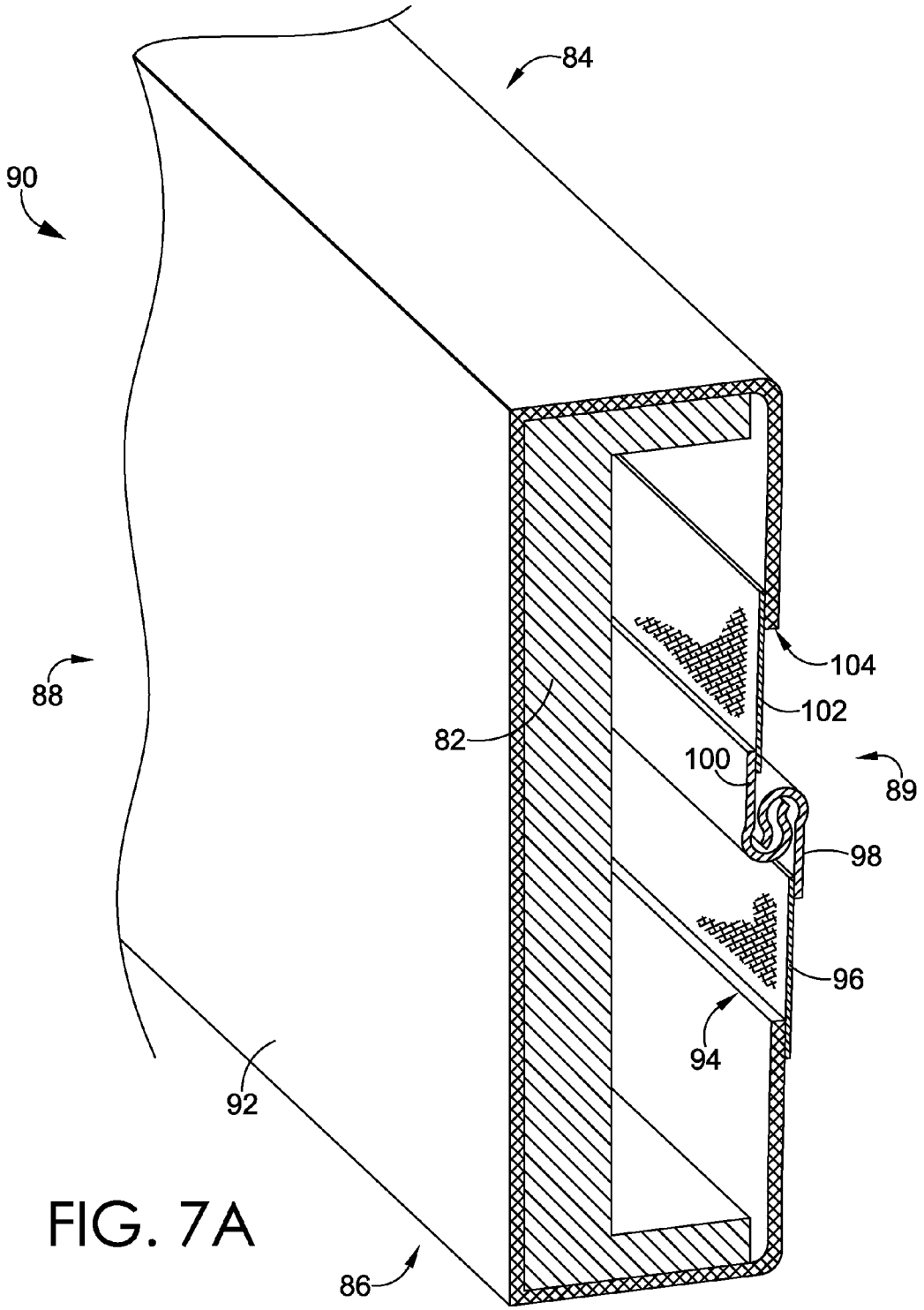
FIG. 7A is a cross-sectional view of a replaceable basecover mechanism configured to cover at least a portion of a shroud, in accordance with an embodiment of the invention.

Turning next to the embodiments of FIG. 7A, a cross-sectional view of a replaceable basecover mechanism 90 is configured to cover at least a portion of a shroud 82 with a covering material 92 that includes a first edge 94 coupled to a stretch panel 96 and a j-shaped upholstery channel 98, and a second edge 104 coupled to a stretch panel 102 and a j-shaped upholstery channel 100. When wrapped around the shroud 82, in one embodiment, the replaceable basecover mechanism 90 provides an exterior side 88 opposite an inner side 89, and an upper side 84 opposite a lower side 86. As the shroud 82 is shown in a vertical orientation, the cross-sectional view of the shroud depicts upper and lower sides 84 and 86 of the shroud 82 being wrapped by the covering material 92 such that, when viewed from the exterior side 88, the inner side 89 is not visible to a user. For example, when used to wrap the shroud 72 of the adjustable bed in FIG. 5, the exterior side 88 may include portions of the covering material 92 without portions of the stretch panels 96 and 102 or the corresponding upholstery channels 98 and 100.

In the example of FIG. 7A, the interlocking j-shaped upholstery channels 98 and 100 are brought in closer proximity to each other based at least in part on an amount of travel of the stretch panels 96 and 102. As such, one or both of the stretch panels 96 and 102 may be extended during joining of the upholstery channels 98 and 100 as the covering material 92 is wrapped around the upper side 84 and lower side 86. In embodiments, the elastic properties of the stretch panels 96 and 102 maintain the covering material 92 in close proximity to an outer surface of the shroud 82. For example, a user viewing the shroud 72 of FIG. 5, covered by the basecover mechanism 90 of FIG. 7A, may be unable to detect the presence of the covering material 92 mated to an exterior of the shroud.

Figure 7B:
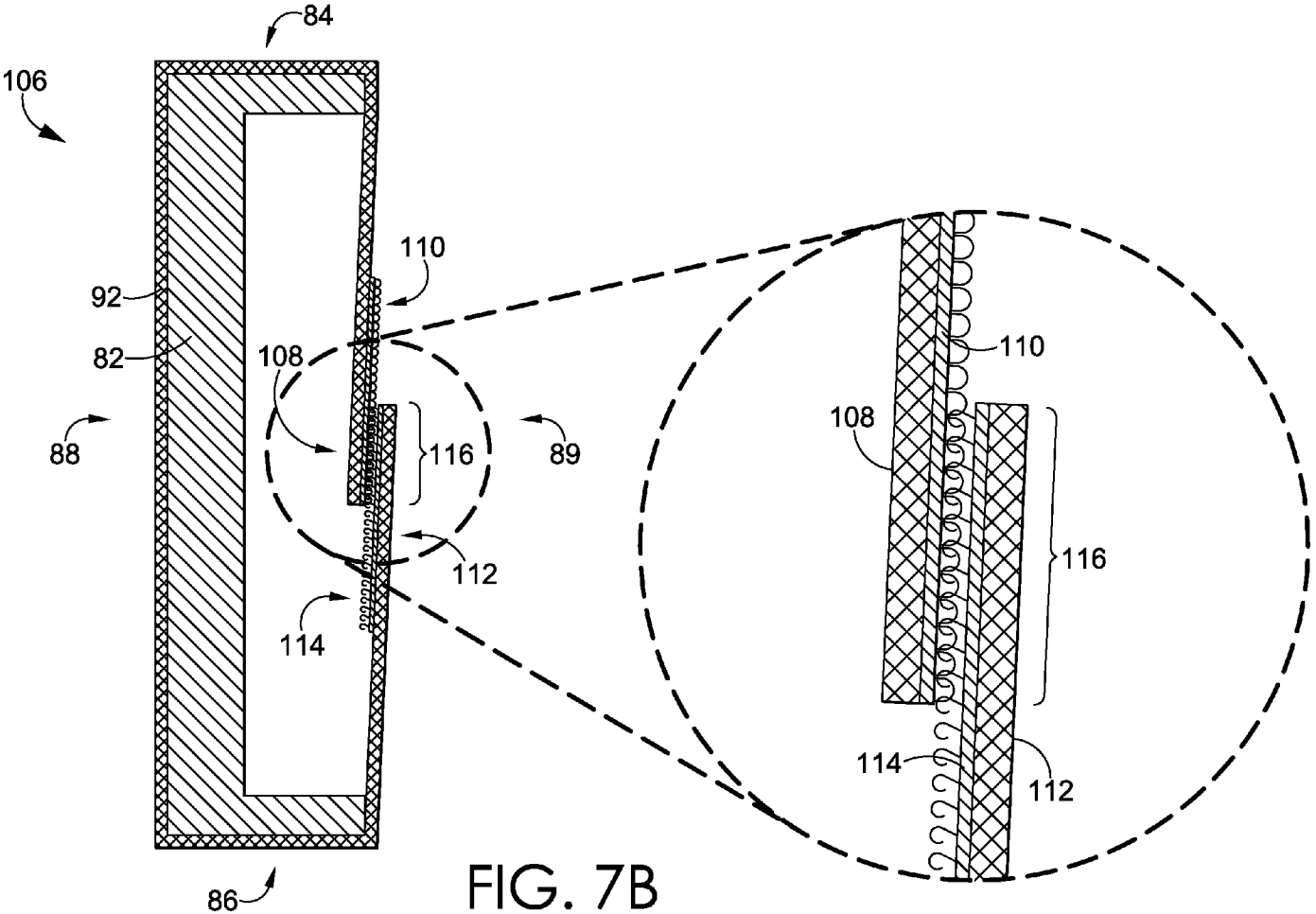
FIG. 7B is a cross-sectional view of a replaceable basecover mechanism configured to cover at least a portion of a shroud, in accordance with an embodiment of the invention.

Turning next to FIG. 7B, a cross-sectional view of a replaceable basecover mechanism 106 is configured to cover at least a portion of a shroud 82 according to an embodiment of the invention. The exemplary replaceable basecover mechanism 106 includes a covering material 92 with a first end 108, a hook/loop closure surface 110, a second end 112, and a hook/loop closure surface 114. As shown in the exemplary enlarged portion of FIG. 7B, the overlapping portion 116 of the first end 108 and the second end 112 provides for a joining of the corresponding hooks and loops from mated surfaces of the loops on hook/loop closure surface 110 and the hooks on hook/loop closure surface 114. In some embodiments, hook/loop closure surface 110 and hook/loop closure surface 114 may include any means for joining mated surfaces, including a hook and loop closure surface such as a Velcro® surface configured to couple to a corresponding surface structure.

Figure 7D:
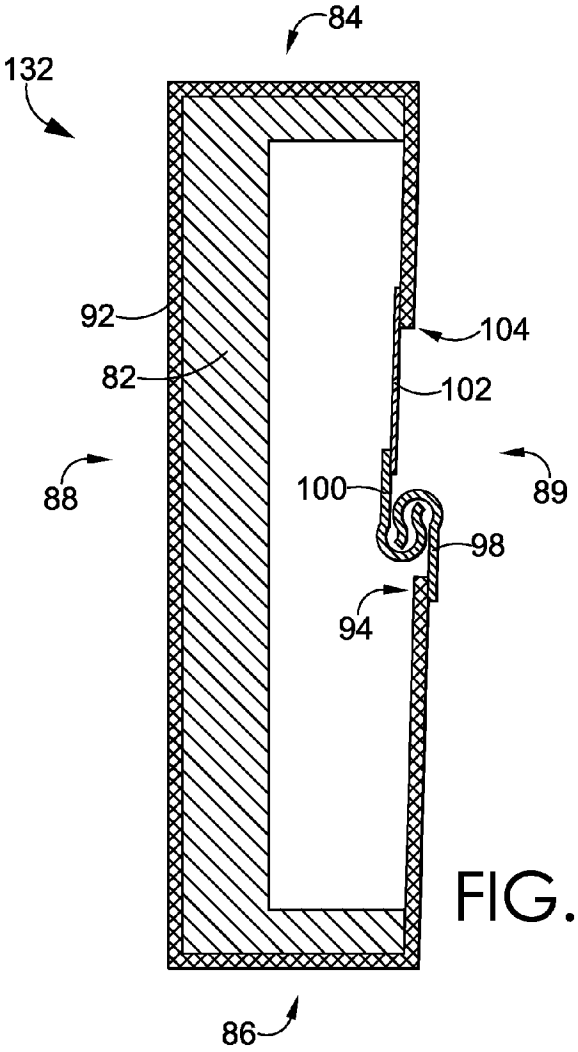
FIG. 7D is a cross-sectional view of a replaceable basecover mechanism configured to cover at least a portion of a shroud, in accordance with an embodiment of the invention.
Figure 7C:
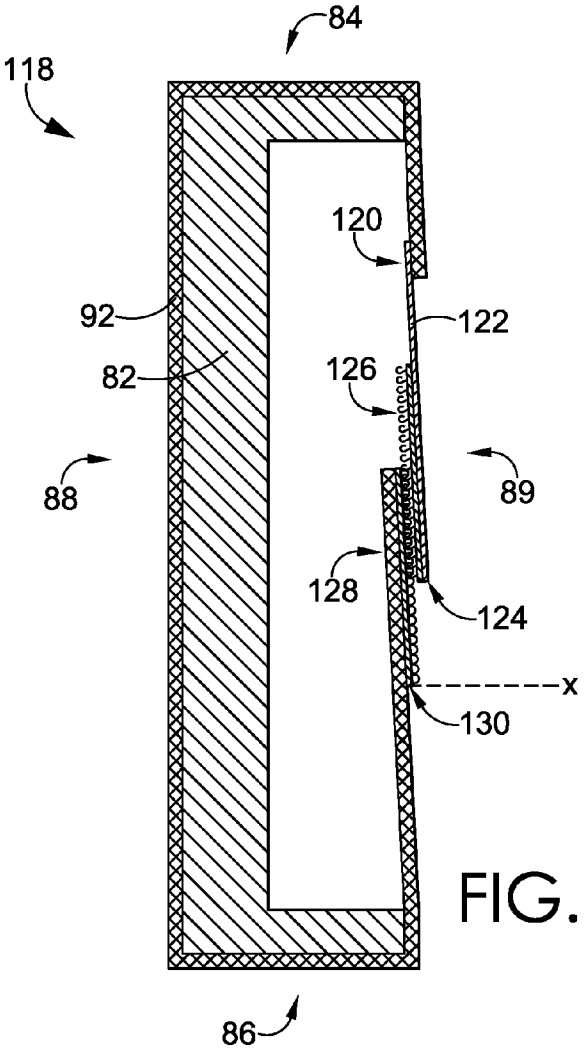
FIG. 7C is a cross-sectional view of a replaceable basecover mechanism configured to cover at least a portion of a shroud, in accordance with an embodiment of the invention.

In the exemplary embodiment of FIG. 7C, the replaceable basecover mechanism 118 includes a first end 120 of the covering material 92 that adjoins a stretch panel 122 having a hook/loop closure surface 126. The hook/loop closure surface 126 is configured to mate with the corresponding hook/loop closure surface 130 of the second end 128. In some aspects, based on an amount of stretching of the stretch panel 122, the stretch panel end 124 may extend all the way to a hook/loop stop point "x." As such, based on the stretch panel 122 permitting travel of the stretch panel end 124, the hook/loop closure surface 130 may at least be covered and/or concealed by the stretch panel 122. In this example, without a stretch panel adjoining the second end 128 of the covering material 92 (i.e., with the hook/loop closure surface 130 applied to the second end 128 of the covering material 92), a replaceable basecover mechanism 118 includes a stationary second end 128 that mates with an extendable and/or moveable stretch panel end 124.

Similarly, the exemplary replaceable basecover mechanism 132 of FIG. 7D includes a stretch panel 102 that mates to the second edge 104 of the covering material 92 and the j-shaped upholstery channel 100. In this example, the first edge 94 of the covering material 92 includes a j-shaped upholstery channel 98 coupled directly to the covering material 92, without a stretch panel permitting travel of the upholstery channel 98 with respect to the covering material 92. In some embodiments, the stretch panel 102 may be moved to a different position on the replaceable basecover mechanism 132 on one or more parts of a covering for a shroud 82. For example, in another embodiment, the j-shaped upholstery channel 100 may be coupled directly to the covering material 92, while the stretch panel 102 may mate to the first edge 94 of the covering material 92 and the j-shaped upholstery channel 98. As such, a single edge of the covering material 92 may remain elastic with respect to the remaining covering material wrapped around the shroud 82, and the stretch panel 102 may be positioned adjacent an upholstery channel 100 closest to the upper side 84, or the stretch panel 102 may be positioned adjacent an upholstery channel 98 closes to the lower side 86.

Figure 8B:
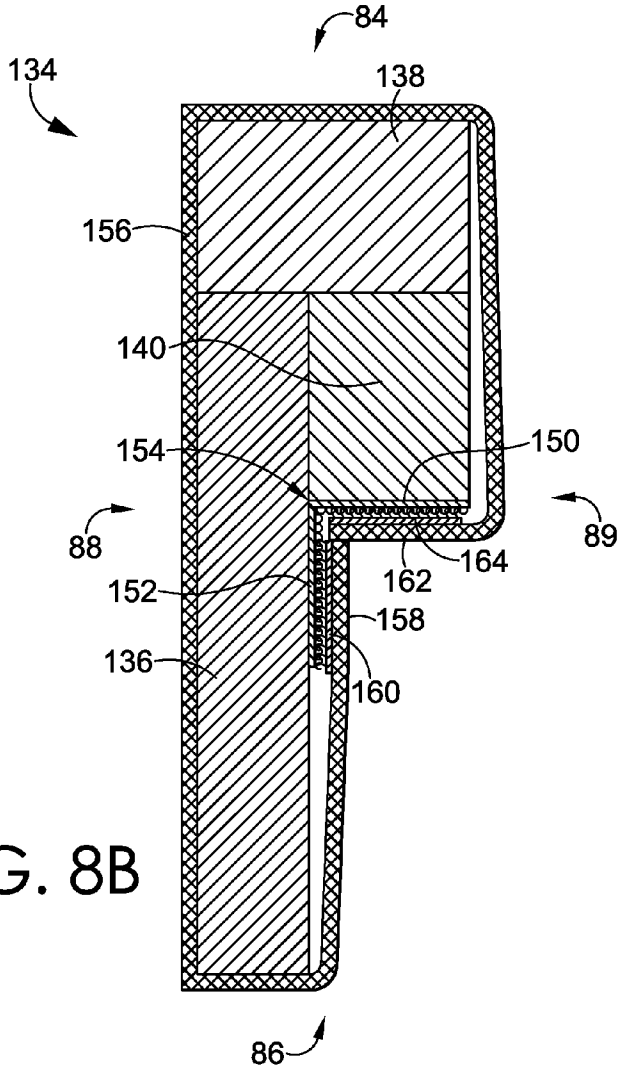
FIG. 8B is a cross-sectional view of a replaceable basecover mechanism configured to cover at least a portion of a shroud, in accordance with an embodiment of the invention.
Figure 8A:
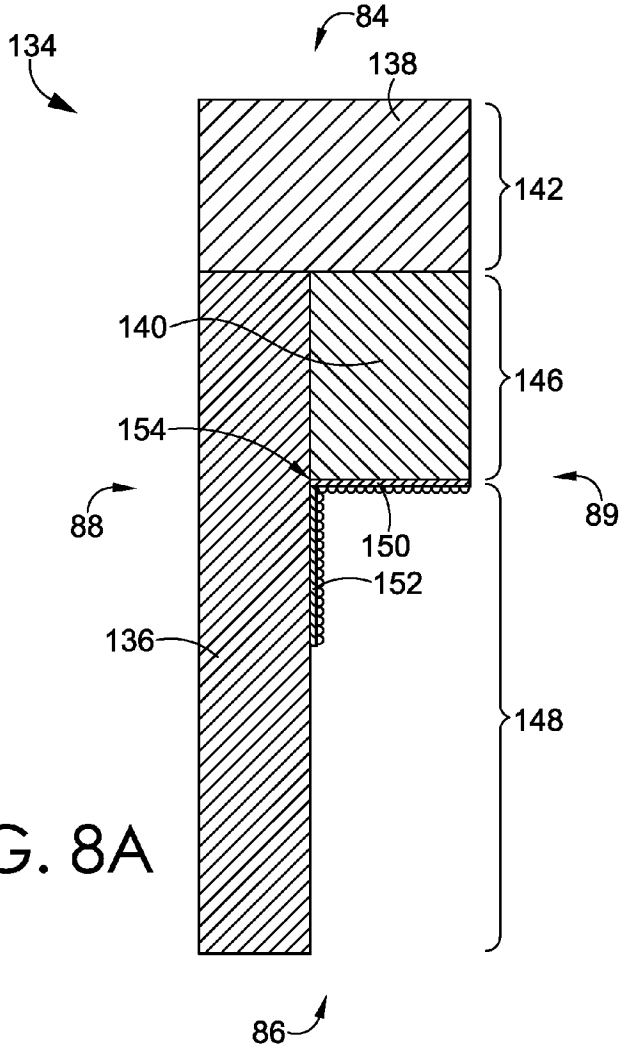
FIG. 8A is a cross-sectional view of an exemplary shroud for covering by a replaceable basecover mechanism, in accordance with an embodiment of the invention.

In one embodiment of the invention, as shown in FIG. 8A, an exemplary shroud 134 for coving by a replaceable basecover mechanism may include a shroud panel 136, a shroud top 138, and a shroud block 140. In one aspect, the shroud panel 136 is positioned vertically along a perimeter of an automated furniture item, such as an adjustable bed. The shroud panel 136 may be wrapped by at least a portion of a surround covering material covering an exterior side 88 and a lower side 86 of the shroud 134. As shown in the example of FIG. 8A, the interior side 89 of the shroud panel 136 may include a hook/loop closure surface 152. In one embodiment, the hook/loop closure surface 152 is adjacent to a hook/loop closure surface 150 on a lower side 86 of the shroud block 140. In one aspect, the shroud 134 includes an upper portion 142 having a shroud top 138 that covers a width of both the shroud panel 136 and the shroud block 140, a middle portion 146 having the shroud block 140 and a portion of the shroud panel 136, and a third portion 148 including a remaining portion of the shroud panel 136. In the example of FIG. 8A, the shroud 134 includes hook/loop closure surfaces 150 and 152 that meet at the corner 154 between the bottom surface of the shroud block 140 and the interior surface of the shroud panel 136.

In FIG. 8B, the cross-sectional view of the replaceable basecover mechanism 156 is configured to cover at least a portion of the shroud 134, in accordance with an embodiment of the invention. In this example, the replaceable basecover mechanism 156 includes a covering material first end 158 with a hook/loop closure surface 160 configured to mate to the hook/loop closure surface 152 of the shroud panel 136. Further, the replaceable basecover mechanism 156 includes a covering material second end 162 with a hook/loop closure surface 164 configured to mate to the hook/loop closure surface 150 of the shroud block 140. In one embodiment of the invention, based on a positioning of the hook/loop closure surface 160 with respect to the hook/loop closure surface 152, and the hook/loop closure surface 164 with respect to the hook/loop closure surface 150, the first end 158 and second end 162 of the replaceable basecover mechanism 156 may provide a consistent covering material that mates at the corner 154 to provide consistent coverage of the entire shroud 134.

Figure 9:
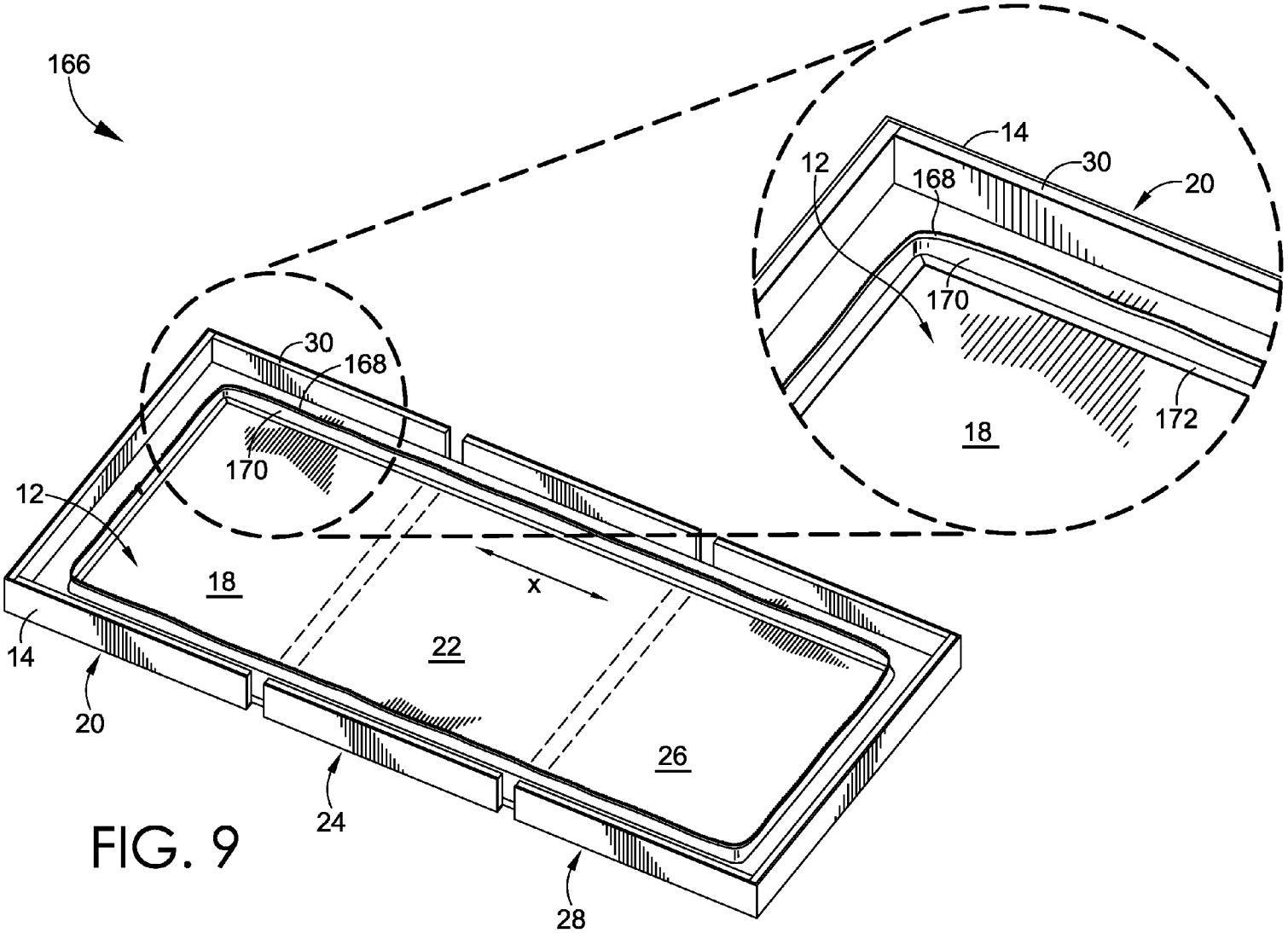
FIG. 9 is a bottom, perspective view of an exemplary adjustable bed deckboard configured to couple to a replaceable basecover mechanism, with an enlarged portion of the deckboard, in accordance with an embodiment of the invention.
Figure 10:
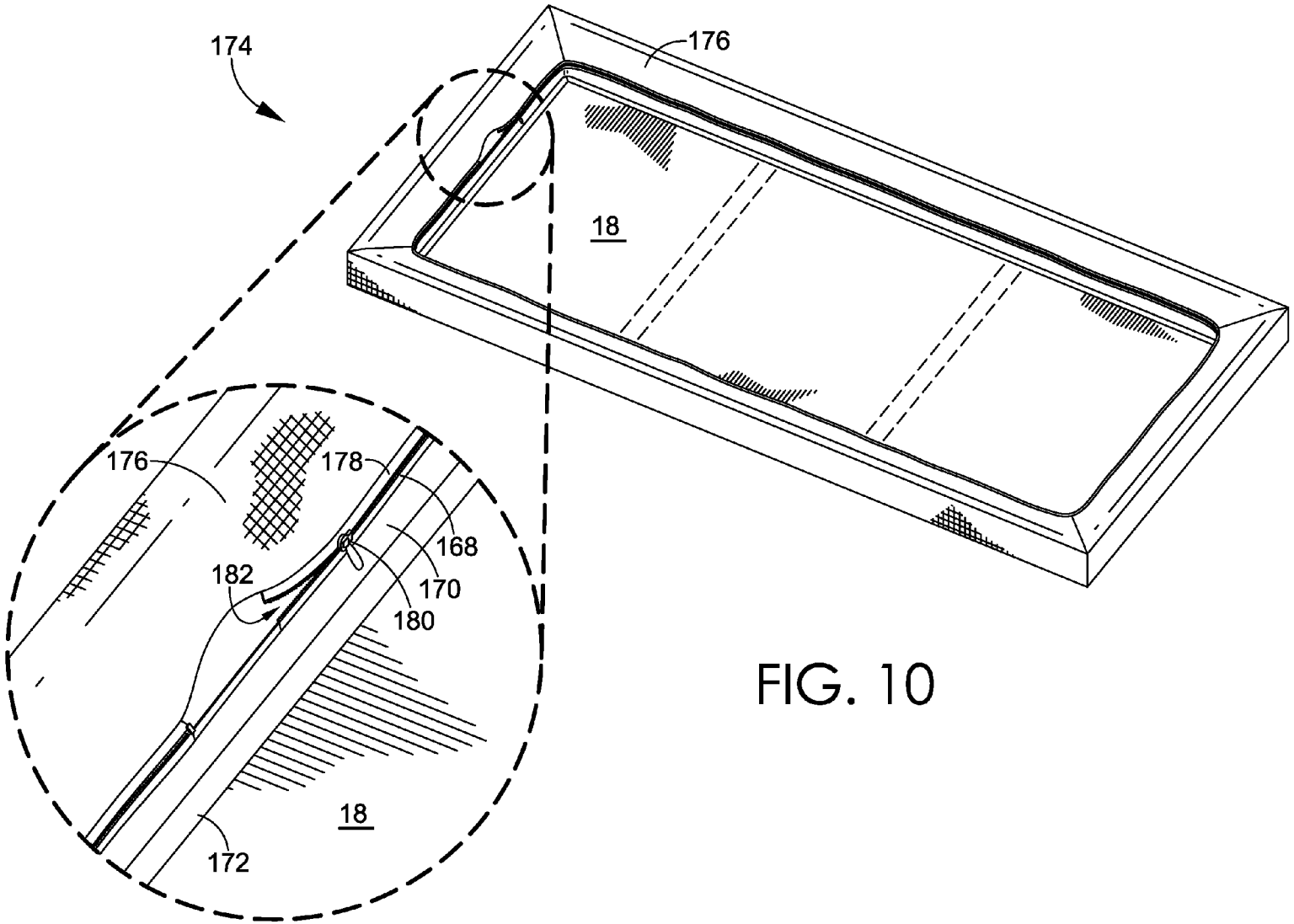
FIG. 10 is a bottom, perspective view of a replaceable basecover mechanism applied to the deckboard of FIG. 9, with an enlarged portion of the replaceable basecover mechanism, in accordance with an embodiment of the invention.

Turning next to FIG. 9, a bottom, perspective view of an exemplary adjustable bed deckboard 166 includes a zipper feature 168 coupled to the bottom surfaces 18, 22, and 26 of the plurality of deckboard panels 12. In the enlarged portion of FIG. 9, the zipper feature 168 is coupled to the bottom surface 18 of the first base portion 20 based on a zipper panel 170 and a zipper panel fastener 172. In one embodiment, the zipper panel 170 may be joined to the bottom surface 18 by a removable or nonremovable zipper panel fastener 172, such as an upholstery staple. As further depicted in FIG. 10, a replaceable basecover mechanism 174 is applied to the plurality of deckboard panels 12 of FIG. 9, with an enlarged portion of the replaceable basecover mechanism, in accordance with an embodiment of the invention. In one embodiment, the basecover material 176 is configured to cover at least a portion of the top and side surfaces of the deckboard panels, wrap around the edges of the deckboard panels, and to be secured to the bottom surface via the zipper feature 168. As such, in one embodiment, the basecover material 176 includes a zipper feature 178 configured to mate to the zipper feature 168 based on travel of the zipper mechanism 180 with respect to an open edge 182 of the mated zipper features 178 and 168. In some aspects, the mated zipper features 16 and 178 provide a removable and/or replaceable basecover mechanism 174 for enclosing an upper surface and outer perimeter of an adjustable bed.

Figure 11:
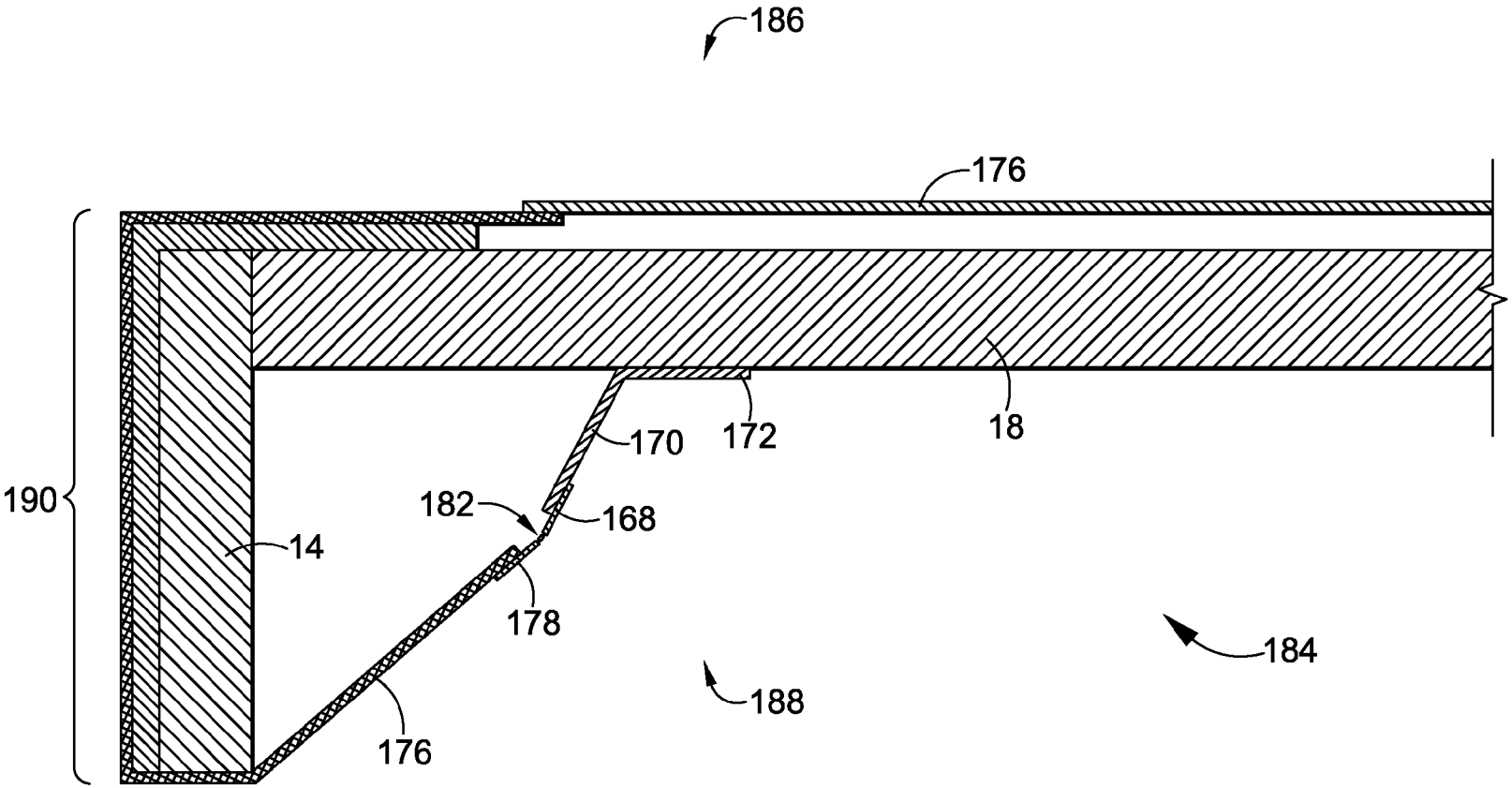
FIG. 11 is a side, cross-sectional view of an exemplary replaceable basecover mechanism applied to a deckboard of an automated furniture item, in accordance with an embodiment of the invention.

With reference finally to FIG. 11, a side, cross-sectional view of an exemplary replaceable basecover mechanism 184 applied to a deckboard of an automated furniture item is provided. Embodiments of the replaceable basecover mechanism 184 includes an upper surface 186 having a replaceable basecover material 176 that wraps from the upper surface 186, around the border portion 190, and down to the lower surface 188. In one aspect, the wrapped replaceable basecover material 176 is joined at the zipper feature 178 to the zipper feature 168 at the open edge 182. In one aspect, the zipper panel 170 may secure one or more portions of the zipper feature 168 to the bottom surface based on a zipper panel fastener 172 applied to one or more portions of the adjustable bed deckboard.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A replaceable basecover mechanism for covering at least a portion of an adjustable furniture item shroud, said replaceable basecover mechanism comprising:

a covering material comprising a first edge and a second edge;

a first coupling mechanism adjacent the first edge;

a second coupling mechanism adjacent the second edge; and a stretch panel adjacent at least one of the first coupling mechanism and the second coupling mechanism, wherein the first coupling mechanism is configured to removably couple to the second coupling mechanism such that the covering material wraps at least a portion of the shroud.

2. The replaceable basecover mechanism of claim 1, wherein the first and second coupling mechanisms are j-shaped upholstery channels.

3. The replaceable basecover mechanism of claim 1, wherein the stretch panel comprises an elastic material.

4. The replaceable basecover mechanism of claim 1, wherein the covering material is configured to removably cover at least a portion of a shroud device associated with the adjustable furniture item.

5. The replaceable basecover mechanism of claim 1, wherein the first and second coupling mechanisms are hook and loop closure surfaces.

6. The replaceable basecover mechanism of claim 1, wherein the covering material wraps at least a portion of the shroud based on removable coupling the first and second coupling mechanisms on an interior side of the shroud.

7. A replaceable covering device for a surround covering, the replaceable covering device comprising:

a covering material comprising:

1) a first edge having a first coupling mechanism; and 2) a second edge having a second coupling mechanism;

wherein the first coupling mechanism is configured to couple to a third coupling mechanism on an interior surface of a shroud, and further wherein the second coupling mechanism is configured to couple to a fourth coupling mechanism on an interior surface of the shroud, wherein the third coupling mechanism and the fourth coupling mechanism are adjacent on the interior surface of the shroud such that adjacent coupling of the first and second coupling mechanisms secures the covering material around the shroud.

8. The replaceable covering device of claim 7, wherein the first and second coupling mechanism are mated to the third and fourth coupling mechanisms on the interior surface of the shroud such that a position of the first edge and a position of the second edge is on an interior surface of the shroud.

9. The replaceable covering device of claim 8, wherein the first and second edges are obstructed from viewing on an exterior surface of the shroud.

10. The replaceable covering device of claim 7, wherein the first coupling mechanism is a loop surface of a hook and loop coupling mechanism and the third coupling mechanism is a hook surface of a hook and loop coupling mechanism.

11. The replaceable covering device of claim 7, wherein the second coupling mechanism is a loop surface of a hook and loop coupling mechanism and the fourth coupling mechanism is a hook surface of a hook and loop coupling mechanism.

12. A replaceable basecover mechanism for a shroud covering comprising:

a covering material for covering at least a portion of a shroud, said covering material having a first edge and a second edge;

a first coupling mechanism coupled to the first edge; and a second coupling mechanism coupled to the second edge, said second coupling mechanism configured to overlap at least a portion of the first coupling mechanism.

13. The replaceable basecover mechanism of claim 12, wherein the covering material surrounds an upper surface, a lower surface, an exterior surface, and at least a portion of the interior surface of the shroud.

14. The replaceable basecover of claim 12, wherein the first and second coupling mechanisms comprise a hook and loop closure surface.

15. The replaceable basecover of claim 14, wherein the first coupling mechanism couples to the second coupling mechanism such that a first edge of the covering material is positioned at a stop edge of the second coupling mechanism.

16. The replaceable basecover of claim 12, further comprising at least one stretch panel.

17. The replaceable basecover of claim 12, wherein a position of each of the first and second coupling mechanisms corresponds to a position of each of the at least one stretch panel.

18. The replaceable basecover of claim 12, wherein each of the first and second coupling mechanisms comprises an upholstery hook channel.

19. The replaceable basecover of claim 12, wherein a replacement covering material is configured to cover the shroud based on a third coupling mechanism coupled to a third edge of the replacement covering material, and a fourth coupling mechanism coupled to a fourth edge of the replacement covering material.

* * * * *